US008407868B2

(12) United States Patent
Chung

(10) Patent No.: US 8,407,868 B2
(45) Date of Patent: Apr. 2, 2013

(54) MANUFACTURING METHOD FOR EYELET AND STRUCTURE THEREOF

(75) Inventor: Do-Jin Chung, Seoul (KR)

(73) Assignee: Qingdao Gyoha En-Tech Co., Ltd., Qingdao (CN)

( * ) Notice: Subject to any disclaimer, the term of this patent is extended or adjusted under 35 U.S.C. 154(b) by 0 days.

(21) Appl. No.: 11/265,505

(22) Filed: Nov. 3, 2005

(65) Prior Publication Data

US 2006/0200954 A1 Sep. 14, 2006

(30) Foreign Application Priority Data

Dec. 24, 2004 (CN) ..... 2004 2 0099243 U

(51) Int. Cl.
*A43C 5/00* (2006.01)

(52) U.S. Cl. ..... 24/713.6; 114/114

(58) Field of Classification Search ..... 24/713.6–713.8; 135/119; 114/114, 115; 16/2.1
See application file for complete search history.

(56) References Cited

U.S. PATENT DOCUMENTS 257,750 A * 5/1882 Parcelle ..... 16/2.1
2,897,028 A * 7/1959 Potter ..... 384/181
4,372,013 A * 2/1983 Gautier, Jr. ..... 16/2.1
6,006,406 A * 12/1999 Chung ..... 24/713.6
6,233,782 B1 * 5/2001 Regele et al. ..... 16/2.1
6,442,808 B2 * 9/2002 Fildan et al. ..... 24/689
7,251,865 B2 * 8/2007 Takamura et al. ..... 24/114.4

FOREIGN PATENT DOCUMENTS

WO WO 2004012550 A1 * 2/2004

* cited by examiner

*Primary Examiner* — Jack W. Lavinder
(74) *Attorney, Agent, or Firm* — McKenna Long & Aldridge LLP

(57) ABSTRACT

The present invention discloses a method for manufacturing an eyelet for a tarpaulin, the eyelet having upper and lower eyelet bodies each provided with a plurality of fixing protrusions formed in a shape of concentric circles on one surface thereof in such a manner that the plurality of fixing protrusions formed on the upper eyelet body confront to the plurality of fixing protrusions formed on the lower eyelet body, the method comprising the following steps of: a step of positioning the upper and lower eyelet bodies by using a conveying means in such a manner as to place the tarpaulin there between; a step of punching a given position on the tarpaulin fabric by means of a punching machine with an integrally-formed ultrasonic horn; a step of conveying the upper and lower eyelet bodies to a position of the ultrasonic horn and fusing the upper and lower eyelet bodies to the tarpaulin through the compression of the ultrasonic horn; a step of fusing a protruded part extending upwardly from the circumference of a through-hole of the lower eyelet body by compression in the ultrasonic-fusing step to form an inner circumferential edge part; and a step of passing a rope through the through-hole of the eyelet mounted on the tarpaulin.

8 Claims, 8 Drawing Sheets

MANUFACTURING METHOD FOR EYELET AND STRUCTURE THEREOF

This application claims priority to Chinese Application No. 20040099243.7 filed on Dec. 24, 2004 and is incorporated by reference, as if fully set forth herein.

TECHNICAL FIELD

The present invention relates to an eyelet for a tarpaulin, and more particularly, to a method for manufacturing an eyelet for a tarpaulin that is fixedly attached on the edge portion of a tarpaulin fabric for passing a rope there through and to an improved structure of such an eyelet.

BACKGROUND ART

A tarpaulin is widely used to cover articles in freight vehicles or warehouses so that the articles are kept safely in even rain or sunshine. Generally, a tarpaulin is used in such a fashion as to be secured at the edge portion thereof by means of a string or rope, and at this time, so as to prevent a tarpaulin fabric from being damaged, eyelets are attached along the edge portion of the tarpaulin fabric and the string or rope is passed through the eyelets. Then, the eyelet and the string or rope are in close contact with each other, so that the punched portion on the tarpaulin fabric can be completely protected, without any damage or tearing out.

It is well known that a tarpaulin is made such that a fabric is formed by weaving weft yarn formed of low-density polyethylene and warp yarn formed of high-density ethylene and the same polyethylene is coated on the upper and lower surfaces of the fabric, and therefore, an explanation of such a process of the tarpaulin will be omitted for the brevity of description of the present invention.

After undergoing the process, the tarpaulin is first folded by a predetermined width along the edge portion thereof for the purpose of the reinforcement of the edge portion, and then, a plurality of through-holes are punched on the folded portion at predetermined intervals for attachment of the eyelets thereto.

Examples of typical eyelets include aluminum eyelets and hard plastic eyelets, and the conventional eyelets are made by using an upper mold and a lower mold.

An aluminum eyelet before mounting is comprised of a lower cylindrical body and an upper disc, the lower cylindrical body having a bottom plate and a cylinder placed upwardly on the bottom plate. The cylinder has a height of about 6 mm to 8 mm. The upper disc has a generally round ring formed in the intermediate portion thereof, the round ring being concave at the inside thereof, and also has a flange turned over around the outer periphery thereof. A method of mounting the aluminum eyelet on the tarpaulin is embodied by using an eyelet-punching machine. After the hole for the eyelet is formed on the tarpaulin fabric, the lower cylindrical body and the upper disc are coupled by mean of a rivet in a rigidly compressed state, and the cylindrical portion of the lower cylindrical body is compressed and molded in a shape of a protruded round loop in such a manner as to be coupled with the inside of the concaved round ring in the intermediate portion of the upper disc. As a result, the lower cylindrical body and the upper disc are formed as an integral body with each other and then mounted on the tarpaulin fabric. The rope, which is used for fixing the tarpaulin fabric, is passed through the inside of the hole formed in the center portion of the eyelet, such that the tarpaulin fabric can be fixed to a given fixed object.

The hard plastic eyelet has generally the same structure as the aluminum eyelet, except that a plurality of protrusions of a predetermined thickness are formed in a shape of a circle on the top surface of the bottom plate of the lower cylindrical body and on the bottom surface of the upper disc. The protrusions are inserted into the tarpaulin fabric upon coupling of the eyelet with the tarpaulin fabric, thereby achieving the rigid attachment of the eyelet to the tarpaulin fabric.

However, such the conventional types of eyelets have had the following disadvantages:

First, the rivet-coupled way between the lower cylindrical body and the upper disc of the eyelet results in the failure of the close connection between the eyelet and the tarpaulin fabric. That is, a clearance between the eyelet and the tarpaulin fabric is left, and if an external force is applied to the rope passed through the eyelet, the eyelet becomes easily loose such that it is moved together with the rope over the tarpaulin fabric. In some cases, the eyelet may be deformed and even deviated from the tarpaulin fabric. Furthermore, the tarpaulin fabric can be torn around the fixed portion to the eyelet, and if it is so, the torn portion can be rapidly extended, which may cause the whole of tarpaulin fabric to be useless.

Second, most of tarpaulin fabrics are made of plastic that is different from the aluminum eyelet material. According to the environment protection requirements prescribed in many countries, when the usage duration of the tarpaulin fabric elapses, the aluminum eyelet should be inconveniently detached from the tarpaulin fabric because it is not recycled, which makes the load of the process increased. On the other hand, the hard plastic eyelet can be recycled, but it should be separately detached from the tarpaulin fabric because of the hardness difference of the materials between the hard plastic eyelet and the tarpaulin fabric.

Third, since the aluminum eyelet and the hard plastic eyelet are all hard, they are easily deformed to undesirably form an edge portion around the outer peripheral surface thereof after the usage of a predetermined period of time, which causes an operator to be hurt on his or her hand when the rope is passed therethrough.

Fourth, the production costs are relatively high.

Fifth, the manufacturing process is relatively complicated.

Sixth, since the eyelet has the different structures between the lower cylindrical body and the upper disc, the parts are delivered individually during the production of the eyelet, and the process of mounting the eyelet is complicated, while having the low efficiency.

Finally, the eyelet has a relatively complicate shape, and since the upper cylindrical body has a predetermined height, relatively large space for the delivery is occupied.

DISCLOSURE OF INVENTION

Accordingly, the present inventor has been made to solve the above-described problems occurring in the prior art, and it is an object of the present invention to provide an eyelet for tarpaulin that can be fixed rigidly on a tarpaulin fabric, recycled together with the tarpaulin fabric, provide low production costs, and have simple production and mounting processes, so that the problems associated with conventional eyelets are all resolved.

To achieve the above object, according to the present invention, there is provided an eyelet for tarpaulin including: upper and lower eyelet bodies having the same shape as each other and formed in a shape of a generally round loop, each of the upper and lower eyelet bodies being generally flat at a top surface thereof.

According to the present invention, preferably, each of the upper and lower eyelet bodies is generally flat at a bottom surface thereof.

Preferably, each of the upper and lower eyelet bodies may be provided with a plurality of fixing protrusions formed on the top surface thereof in such a manner as to be arranged in a shape of a plurality of concentric circles.

Preferably, each of the plurality of fixing protrusions may be formed in a shape of a column, a cone, a lug or the like.

Preferably, the plurality of fixing protrusions may be arranged to form an inner concentric circle, an intermediate concentric circle and an outer concentric circle on the top surface of each of the upper and lower eyelet bodies in such a manner that an interval between respective two adjacent fixing protrusions of the inner and outer concentric circles is relatively smaller, and an interval between two adjacent fixing protrusions of the intermediate concentric circle is relatively larger.

Also, preferably, each of the upper and lower eyelet bodies is provided with a plurality of fixing protrusions formed on the top and bottom surfaces thereof in such a manner as to be arranged in a shape of a plurality of concentric circles.

To achieve the above object, according to the present invention, there is provided a method for manufacturing an eyelet for a tarpaulin, the eyelet having upper and lower eyelet bodies each provided with a plurality of fixing protrusions formed in a shape of concentric circles on one surface thereof in such a manner that the plurality of fixing protrusions formed on the upper eyelet body confront to the plurality of fixing protrusions formed on the lower eyelet body, the method comprising the following steps of: a step of positioning the upper and lower eyelet bodies by using a conveying means in such a manner as to place the tarpaulin therebetween; a step of punching a given position on the tarpaulin fabric by means of a punching machine with an integrally-formed ultrasonic horn; a step of conveying the upper and lower eyelet bodies to a position of the ultrasonic horn and fusing the upper and lower eyelet bodies to the tarpaulin through the compression of the ultrasonic horn; a step of fusing a protruded part extending upwardly from the circumference of a through-hole of the lower eyelet body by compression in the ultrasonic-fusing step to form an inner circumferential edge part; and a step of passing a rope through the through-hole of the eyelet mounted on the tarpaulin.

Preferably, the lower eyelet body has the protruded part extending upwardly from the through-hole thereof in such a manner as to be fit around the through-hole of the upper eyelet body.

Preferably, the protruded part of the lower eyelet body is formed in such manner as to be protruded higher than the top surface of the upper eyelet body and when the upper and lower eyelet bodies are coupled with each other, the protruded part is fused by means of ultrasonic welding to thereby form an inner circumferential edge part therealong.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Figure 1:
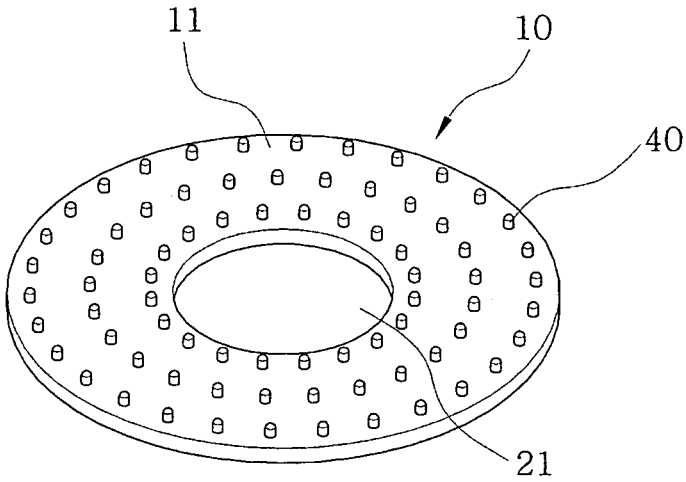
FIG. 1 is a perspective view showing an eyelet for tarpaulin according to an embodiment of the present invention.
Figure 2:
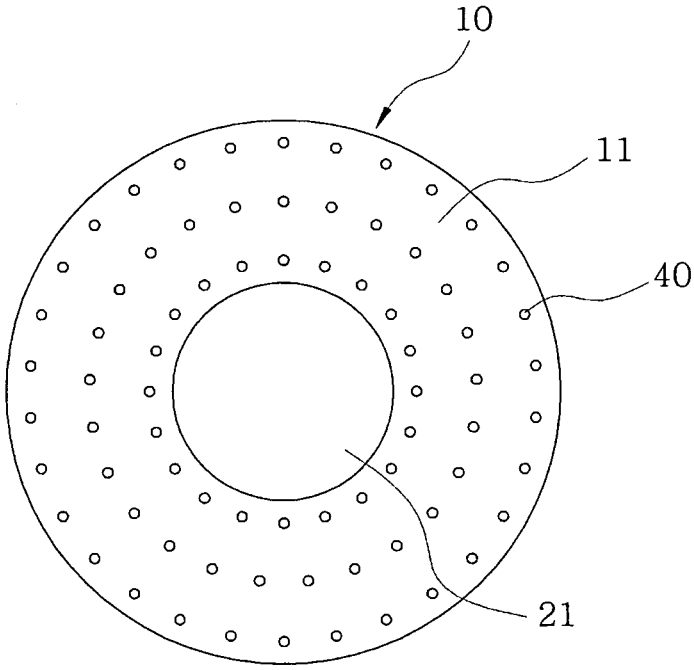
FIG. 2 is a plan view showing the eyelet for tarpaulin according to the present invention.
Figure 3:
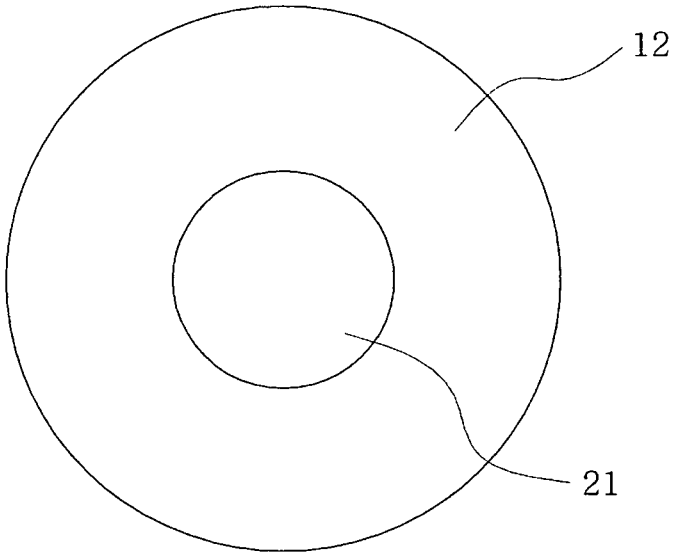
FIG. 3 is a bottom view showing the eyelet for tarpaulin according to the present invention.
Figure 4:
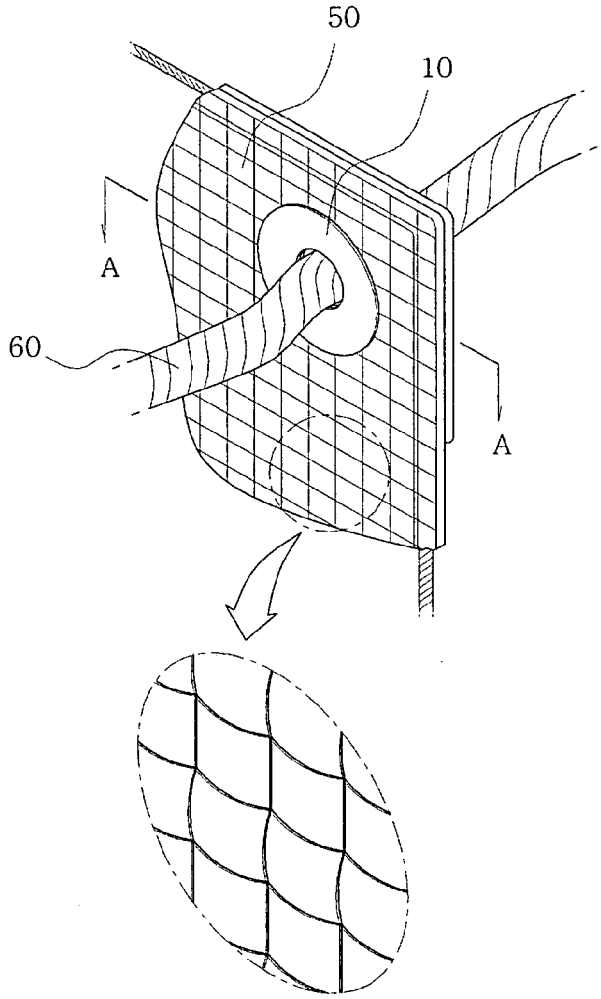
FIG. 4 is a view showing an example of the eyelet of this invention mounted on a tarpaulin fabric.
Figure 5:
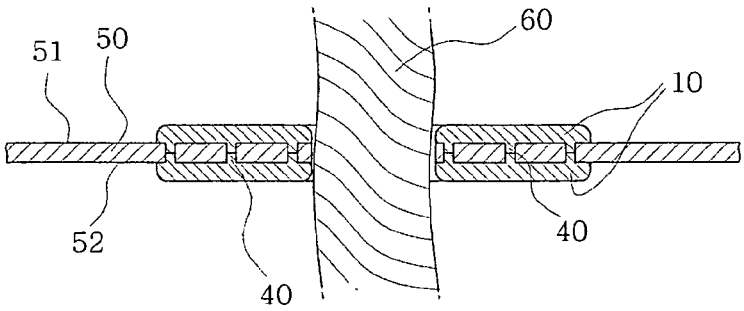
FIG. 5 is a sectional view showing the eyelet of this invention taken along the line A--A of FIG. 4.

Now, an explanation on a preferred embodiment of the present invention will be in detail given with reference to FIGS. 1 to 5.

Upper and lower eyelet bodies 10 that are adapted to be fixed on the top and bottom surfaces of a tarpaulin fabric 50 have the same structure as each other and are in a shape of a generally round loop. Each of the upper and lower eyelet bodies 10 is generally flat at top and bottom surfaces 11 and 12 thereof. Each of the upper and lower eyelet bodies 10 is provided with a plurality of fixing protrusions 40 that are formed on the top surface 11 thereof in such a manner as to be arranged in a shape of at least three or more concentric circles. Each of the plurality of fixing protrusions 40 is protruded upwardly. The plurality of fixing protrusions 40 are arranged to form an inner concentric circle, an intermediate concentric circle and an outer concentric circle on the top surface 11 of each of the upper and lower eyelet bodies 10 in such a manner that an interval between respective two adjacent fixing protrusions of the inner and outer concentric circles is relatively smaller, and an interval between two adjacent fixing protrusions of the intermediate concentric circle is relatively larger.

Each of the upper and lower eyelet bodies 10 has the thickness of 1 mm, the outer diameter of 30 mm, and the inside diameter of 12 mm, and since it is formed by admixing materials (LDPE/HDPE), it is relatively soft.

As the eyelet of the present invention is made of a substantially soft material, it may be called a soft plastic eyelet, but it is simply called an eyelet in the description of the present invention.

The plurality of fixing protrusions 40 are formed in a ultrasonic welding way in the above-mentioned arrangement with the three or more concentric circles, and otherwise, the plurality of fixing protrusions 40 are arranged in a shape of a plurality of concentric circles on the whole of top surface 11 and then welded thereon.

Figure 6:
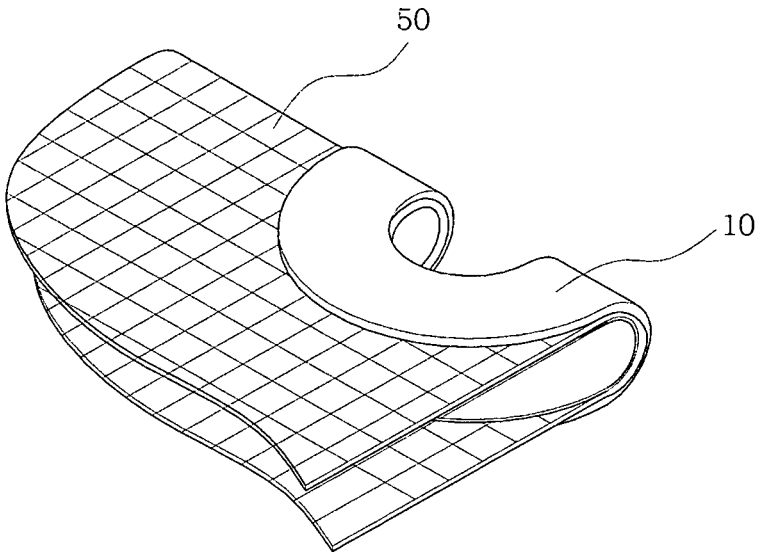
FIG. 6 is a view showing the example of the eyelet folded after mounting on the tarpaulin fabric.

Moreover, since the upper and lower eyelet bodies are formed of a substantially soft material, as shown in FIG. 6, they can be easily bent by using a user's hand and further can be folded for the delivery. Because of the soft material, the eyelet of the present invention can completely resolve the problem of safety that a user may be hurt on his or her hand by the damage or abrasion thereof.

If the upper and lower eyelet bodies 10 are to be attached onto the tarpaulin fabric, the upper eyelet body 10 is mounted to the top surface 51 of the plastic tarpaulin fabric 50, and the lower eyelet body 10 is mounted to the bottom surface 52 thereof. The top surfaces 11 of the upper and lower eyelet bodies 10 on which the plurality of fixing protrusions 40 are formed are disposed toward the tarpaulin fabric 50, and the upper and lower eyelet bodies 10 are welded as an integral body with the tarpaulin fabric 50 with the help of an ultrasonic welding machine. At the time of welding, the plurality of fixing protrusions 40 on the top surfaces 11 of the upper and lower eyelet bodies 10 that are contacted with the tarpaulin fabric 50 are melted by application of ultrasonic waves, thereby being welded to the tarpaulin fabric 50. After welding, the flat portion on the top surface 11 of each of the upper and lower eyelet bodies 10 is tightly contacted with the tarpaulin fabric 50, and the plurality of fixing protrusions 40 are inserted into the interior of the tarpaulin fabric 50 as they are welded as an integral body with the tarpaulin fabric 50.

Figure 7:
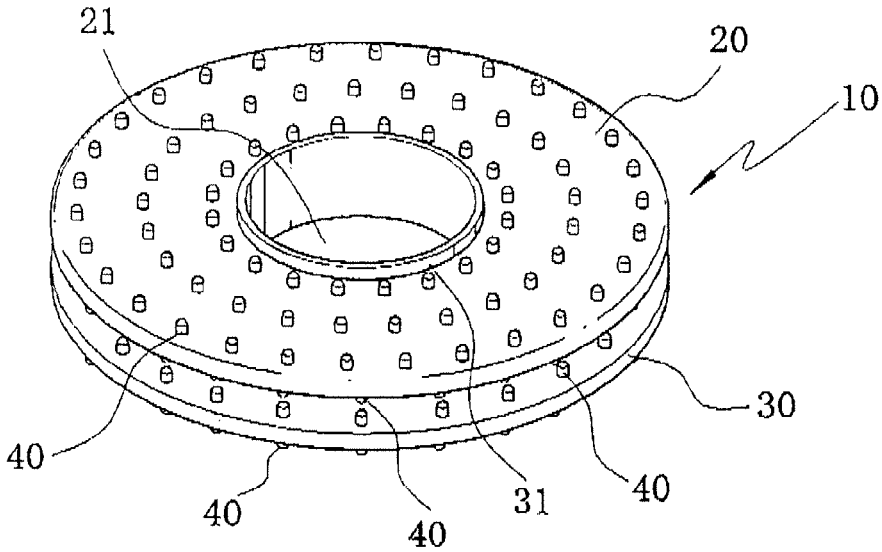
FIG. 7 is a perspective view showing the coupled relation between the upper and lower eyelet bodies of an eyelet for a tarpaulin according to another embodiment of the present invention.

FIG. 7 is a perspective view showing the coupled relation between upper and lower eyelet bodies of an eyelet for a tarpaulin according to another embodiment of the present invention, wherein the upper and lower eyelet bodies 20 and 30 each has a plurality of fixing protrusions 40 formed in a shape of concentric circles on one surface thereof.

The eyelet 10 for a tarpaulin according to the present invention includes the upper eyelet body 20 and the lower eyelet body 30. In this case, the upper eyelet body 20 has the plurality of fixing protrusions 40 formed on one surface thereof to face the lower eyelet body 30 and also is flat on the other surface thereof.

The lower eyelet body 30 is provided with a protruded part 31 extending upwardly from the circumference of a through-hole 21 thereof in such a manner as to be fit around the through-hole 21 of the upper eyelet body 20, and when the upper and lower eyelet bodies 20 and 30 are coupled with each other, the protruded part 31 of the lower eyelet body 30 that is protruded higher than the top surface of the upper eyelet body 20 is fused by means of ultrasonic welding to thereby form an inner circumferential edge part 32.

In the same manner as mentioned above, the lower eyelet body 30 has the plurality of fixing protrusions 40 formed on one surface thereof to face the upper eyelet body 20 and also is flat on the other surface thereof.

Figure 8:
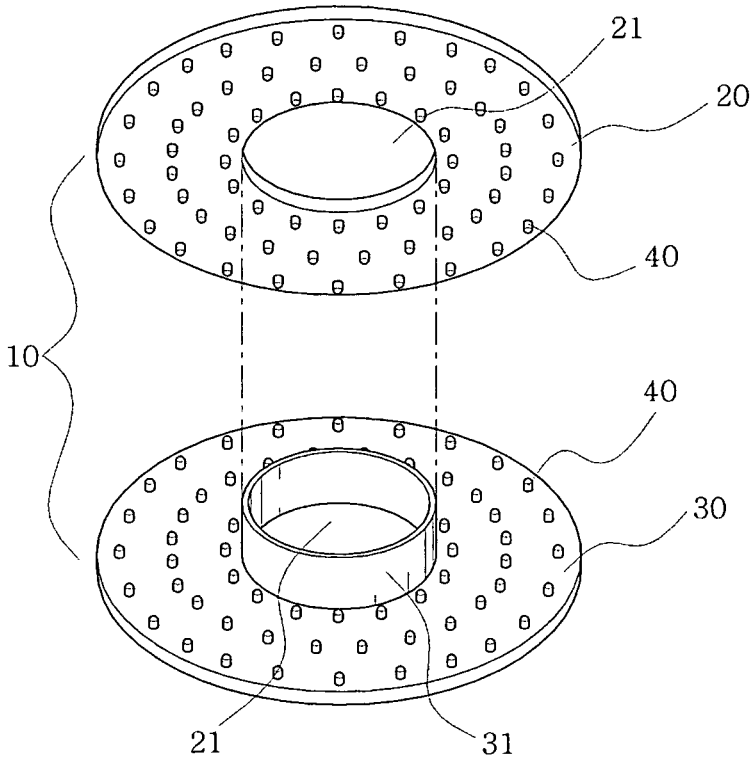
FIG. 8 is an exploded perspective view showing the eyelet for a tarpaulin according to another embodiment of the present invention.

FIG. 8 is an exploded perspective view showing the eyelet for a tarpaulin according to another embodiment of the present invention.

The plurality of fixing protrusions 40, which are formed confront to one another on one surface of each of the upper and lower eyelet bodies, are fused by means of ultrasonic welding to the tarpaulin 50, thereby finishing mounting the eyelet 10 of this invention.

Further, the protruded part 31 is provided around the circumference of the through-hole 21 on the lower eyelet body 30, such that when the upper and lower eyelet bodies 20 and 30 are coupled with each other, the tarpaulin 50 is not exposed through the clearance between the through-holes 21 of the upper and lower eyelet bodies 20 and 30 and also the clearance is not opened anymore.

Figure 9:
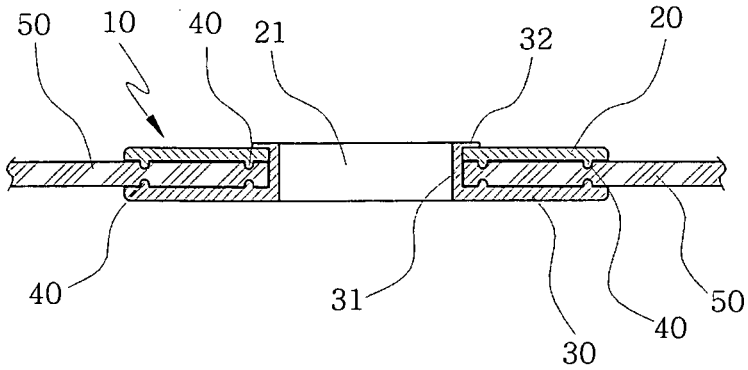
FIG. 9 is a sectional view showing the coupled relation between the upper and lower eyelet bodies of the eyelet for a tarpaulin according to another embodiment of the present invention.
Figure 10:
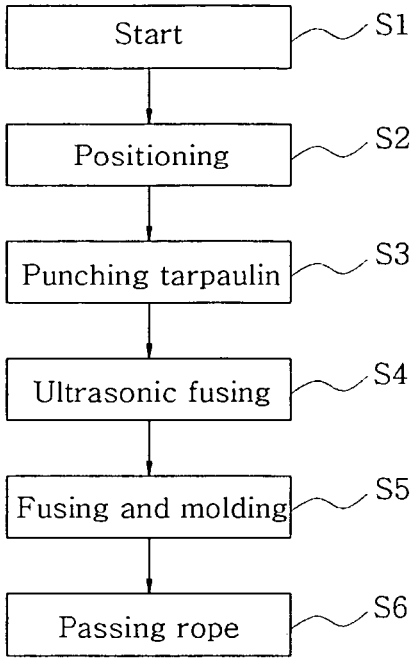
FIG. 10 is a flowchart showing the processes of manufacturing the eyelet for a tarpaulin according to another embodiment of the present invention.

FIG. 9 is a sectional view showing the coupled relation between the upper and lower eyelet bodies of the eyelet for a tarpaulin according to another embodiment of the present invention, and FIG. 10 is a flowchart showing the processes of manufacturing the eyelet for a tarpaulin according to another embodiment of the present invention.

Now, an explanation of the method of manufacturing the eyelet for a tarpaulin according to the present invention is given with reference to FIGS. 9 and 10.

The method of this invention comprises the steps of: positioning the upper and lower eyelet bodies by using a conveying means in such a manner as to place the tarpaulin fabric therebetween (at step S2); punching a given position on the tarpaulin fabric by means of a punching machine with an integrally-formed ultrasonic horn (at step S3); conveying the upper and lower eyelet bodies to a position of the ultrasonic horn and fusing the upper and lower eyelet bodies to the tarpaulin fabric through the compression of the ultrasonic horn (at step S4); fusing a protruded part extending upwardly from the circumferential of a through-hole of the lower eyelet body by compression in the ultrasonic-fusing step to form an inner circumferential edge part (at step S5); and passing a rope through a through-hole of the eyelet mounted on the tarpaulin (at step S6).

In more detail, the upper and lower eyelet bodies 20 and 30 are positioned by using a conveying means of an ultrasonic fusing machine in such a manner as to place the tarpaulin 50 therebetween, and a given position on the tarpaulin fabric is punched by using a punching machine with the integrally-formed ultrasonic horn. Next, the upper and lower eyelet bodies 20 and 30, which are conveyed to a position on which the ultrasonic horn is disposed, are fused to the tarpaulin fabric as the ultrasonic horn is descended.

At this time, the protruded part 31 of the lower eyelet body 30 is formed in such a manner as to higher than the top surface of the upper eyelet 20, and it is fused to the top surface of the upper eyelet body 20 to thus form the edge part 32, as the ultrasonic horn is compressed.

Figure 11:
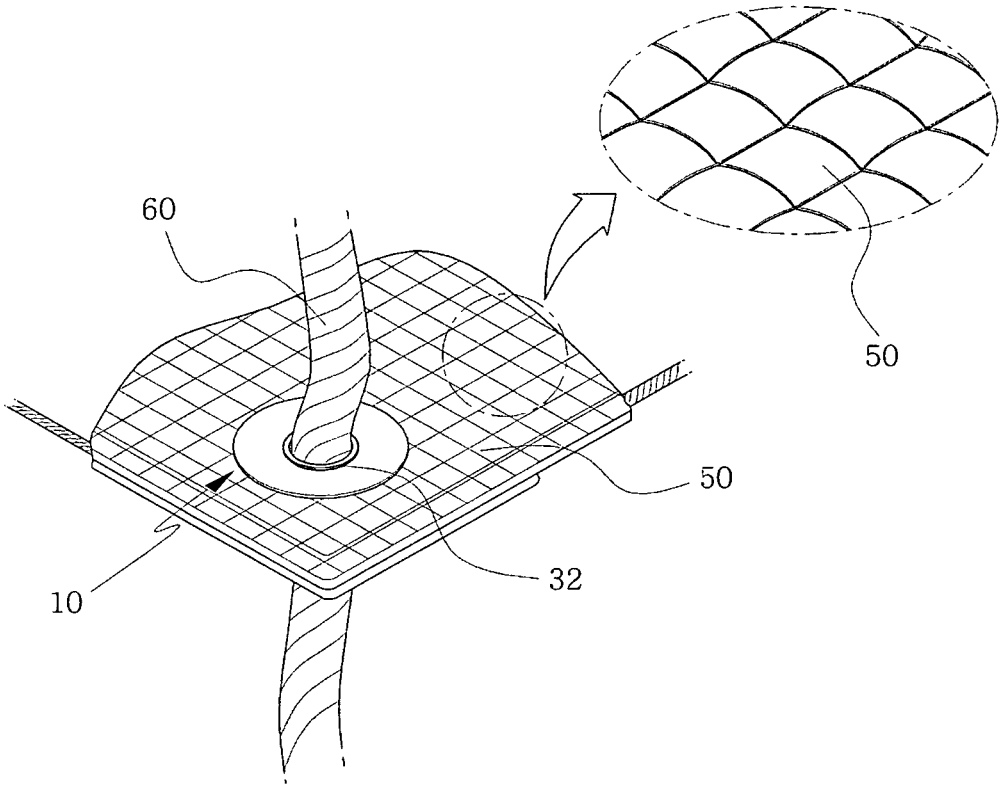
FIG. 11 is a view showing the eyelet of the invention mounted on a tarpaulin fabric according to another embodiment of the present invention.

FIG. 11 is a view showing the eyelet of this invention mounted on a tarpaulin fabric. In this case, the rope 60 is passed through the eyelet 10 mounted on the tarpaulin 50. In the conventional aluminum eyelet and hard plastic eyelet, they have the tension strength different from the tarpaulin, thus to result in the damage on the tarpaulin. However, in the present invention where the soft polyethylene eyelet is provided, the edge part 32 of the eyelet 10 is formed, thus to prevent the tarpaulin from being damaged. Furthermore, the tarpaulin 50 is freely bent because of the eyelet made of a soft material, thus to prevent the tarpaulin from being damaged.

Moreover, since the upper and lower eyelet bodies 20 and 30 are formed of a substantially soft material, they can be easily bent by using a user's hand and further can be folded for the delivery. Owing to its soft material, the eyelet of the present invention can completely resolve the problem of safety that a user may be hurt on his or her hand by the damage or abrasion thereof.

When the eyelet of the present invention is compared with the flat-type of soft plastic eyelet as filed by the same applicant as the present invention and the conventional aluminum eyelet and hard plastic eyelet, the test results of the tension strength at a time of pulling out them and the damage degree of tarpaulin fabric according to the force and time at a given limit are obtained as shown in the following Table:

TABLE 1

| Division | Times | (A) | (B) | (C) | (D) |
|---|---|---|---|---|---|
| Center portion | 1 | 49.9 (Eyelet pull out) | 71.7 (Eyelet pull out) | 418.0 (FR) | 459 (Eyelet Rupture) |
| | 2 | 76.9 (Eyelet pull out) | 73.1 (Eyelet pull out) | 310.0 (FR) | 330 (FR) |
| | 3 | 51.7 (Eyelet pull out) | 53.2 (Eyelet pull out) | 348.0 (FR) | 424 (FR) |
| | 4 | 25.5 (Eyelet pull out) | 54.6 (Eyelet pull out) | 379.0 (FR) | 444 (FR) |
| Corner portion | 1 | 210.0 (Eyelet pull out) | 169.0 (Eyelet pull out) | 555.0 (Eyelet pull out) | 653 (Eyelet Rupture) |
| | 2 | 127.0 (Eyelet pull out) | 159.0 (Eyelet pull out) | 491.0 (Eyelet pull out) | 635 (FR) |
| | 3 | 80.3 (Eyelet pull out) | 182.0 (Eyelet pull out) | 515.0 (FR) | 824 (Eyelet Rupture) |
| | 4 | 131.0 (Eyelet pull out) | 140.0 (Eyelet pull out) | 386.0 (FR) | 711 (Eyelet pull out) |

Wherein (A) represents a conventional hard plastic eyelet, (B) represents a conventional aluminum eyelet, (C) represents a flat-type of soft plastic eyelet according to the present invention, (D) represents the coupling-type of soft plastic eyelet of this invention, the unit of the force is Newton, and FR indicates fabric rupture.

Table 1 shows the experimental data obtained in Korea fiber technology research institute, and as appreciated from the Table 1, the eyelet of this invention has more excellent data values in the tension strength at a time of pulling out it and the force and time at the given limit than the conventional flat-type of soft plastic eyelet and the conventional aluminum eyelet and hard plastic eyelet.

The phrase 'the eyelet pulls out' used in Table 1 means that the eyelet is deviated from the tarpaulin fabric in a state where the tarpaulin fabric is not torn at all or damaged, the 'FR (fabric rupture)' means that when a force is applied at the given limit, the tarpaulin fabric is torn or damaged, and the eyelet rupture means that when a force is applied at the given limit, the eyelet is torn or damaged.

These data show the differences of tension strengths between the eyelet of this invention and the conventional eyelets at the corner portion of the eyelet (which is the portion where the coupled section of the eyelet bodies and the tarpaulin fabric to be contacted therewith face each other) and the center portion of the eyelet (which is the portion where the eyelet is mounted on the tarpaulin fabric).

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

FIG. 11 is a view showing the eyelet of the invention mounted on a tarpaulin fabric according to another embodiment of the present invention. Each of the upper and lower eyelet bodies (10) is provided with a plurality of fixing protrusions (40) formed on the top and bottom surface (11, 12) thereof in such a manner as to be arranged in a shape of a plurality of concentric circles.

Industrial Applicability

As set forth in the foregoing, the method for manufacturing an eyelet for a tarpaulin and the structure of the same eyelet according to the present invention has the following advantages and effects.

First, the upper and lower eyelet bodies have the same shape, and since they are formed of a generally flat round loop, they are rigidly contacted with the tarpaulin fabric on the whole surface thereof through an adhesive welding way where the upper and lower eyelet bodies are welded with the plastic tarpaulin fabric by using the energy generated through ultrasonic vibration. As the strength of rope applied to the eyelet becomes stronger, the coupling between the upper and lower eyelet bodies becomes more rigid, which prevents the eyelet from being loose or deviated from the tarpaulin fabric.

Second, with the formation of the plurality of fixing protrusions on the upper and lower eyelet bodies, the eyelet can be rigidly attached on the tarpaulin fabric, and more particularly, the protruded part of the lower eyelet body is compressed and fused on the top surface of the upper eyelet body, thereby forming the edge part around the through-hole of the upper eyelet body, such that the eyelet of this invention is not deviated from the tarpaulin fabric.

Third, since the upper and lower eyelet bodies are made of soft plastic, they can be recycled together with the plastic tarpaulin, which addresses and solves the conventional problem of environmental pollution.

Fourth, the upper and lower eyelet bodies exhibit an excellent elastic restoring performance because they are made of soft plastic, such that it is not deformed to form the edge portion, which prevents an operator from being hurt on his or her hand.

Fifth, the production costs can be greatly reduced.

Sixth, when the upper and lower eyelet bodies are coupled with each other, the tarpaulin is not exposed through the clearance between the through-holes of the upper and lower eyelet bodies and also the clearance is not opened anymore, which enhances the outer appearance and coupling force thereof.

Finally, since the eyelet is configured in a generally flat round loop, it is small in volume, such that a large number of eyelets can be easily stacked in a box (envelope) , which reduces the space for delivery.

As set fourth in the foregoing, the upper and lower eyelet bodies and the plastic tarpaulin are welded such that they can be rigidly coupled and also all recycled, and the eyelet for a tarpaulin of the present invention has another advantages in that it accomplishes a reduction in production costs, high production efficiency, and a decrease in delivery space and distribution costs.

What is claimed is:

1. An eyelet for tarpaulin comprising:

upper and lower eyelet bodies made of soft plastic that is bendable and foldable and having the same shape as each other and formed in the same shape of a generally round loop, each of the upper and lower eyelet bodies being generally flat at a top surface thereof, the upper eyelet body has a plurality of fixing protrusions formed on a bottom surface and the lower eyelet body has a plurality of fixing protrusions formed on a top surface, wherein the fixing protrusions of the upper and the lower bodies confront each other and formed to be integrated into the tarpaulin by being melted through thermal welding.

2. The eyelet for tarpaulin as claimed in claim 1, wherein each of the upper and lower eyelet bodies is generally flat at a bottom surface thereof.

3. The eyelet for tarpaulin as claimed in claim 1, wherein each of the upper and lower eyelet bodies is provided with a plurality of fixing protrusions formed on the top surface thereof in such a manner as to be arranged in a shape of a plurality of concentric circles.

4. The eyelet for tarpaulin as claimed in claim 3, wherein each of the plurality of fixing protrusions is formed in a shape of a column, a cone, or a lug.

5. The eyelet for tarpaulin as claimed in claim 4, wherein the plurality of fixing protrusions are arranged to form an inner concentric circle, an intermediate concentric circle and an outer concentric circle on the top surface of each of the upper and lower eyelet bodies in such a manner that an interval between respective two adjacent fixing protrusions of the inner and outer concentric circles is relatively smaller, and an interval between two adjacent fixing protrusions of the intermediate concentric circle is relatively larger.

6. The eyelet for tarpaulin as claimed in claim 1, wherein each of the upper and lower eyelet bodies is provided with a plurality of fixing protrusions formed on the top and bottom surface thereof in such a manner as to be arranged in a shape of a plurality of concentric circles.

7. The eyelet for tarpaulin as claimed in claim 3, wherein the lower eyelet body has a protruded part extending upwardly from a circumference of a through-hole thereof in such a manner as to be fit around a through-hole of the upper eyelet body.

8. The eyelet for a tarpaulin as claimed in claim 7, wherein the protruded part of the lower eyelet body is formed in such manner as to be protruded higher than the top surface of the upper eyelet body.

* * * * *